US008029324B1

(12) United States Patent
Yi et al.

(10) Patent No.: US 8,029,324 B1
(45) Date of Patent: Oct. 4, 2011

(54) RF CONNECTOR ASSEMBLY

(75) Inventors: Chong Hun Yi, Mechanicsburg, PA (US); Stephen J. Morley, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/939,882

(22) Filed: Nov. 4, 2010

(51) Int. Cl.
*H01R 13/434* (2006.01)

(52) U.S. Cl. ..... 439/745

(58) Field of Classification Search ..... 439/745, 439/748, 700, 247, 248
See application file for complete search history.

(56) References Cited

U.S. PATENT DOCUMENTS 3,825,874 A * 7/1974 Peverill ..... 439/579
4,362,350 A * 12/1982 von Harz ..... 439/607.12
6,386,913 B1 * 5/2002 Mohammad et al. ..... 439/579
6,386,914 B1 * 5/2002 Collins et al. ..... 439/579
7,341,473 B2 * 3/2008 Gaidosch ..... 439/404
7,416,415 B2 * 8/2008 Hart et al. ..... 439/63
7,601,028 B2 * 10/2009 Eckel et al. ..... 439/579
7,736,199 B2 * 6/2010 Cossette ..... 439/745
2010/0029143 A1 * 2/2010 Cossette ..... 439/745

* cited by examiner

*Primary Examiner* — Tulsidas Patel
*Assistant Examiner* — Harshad Patel

(57) ABSTRACT

An electrical connector assembly includes a housing that has an insert and an organizer separate from, and coupled to, the insert. The insert and the organizer have insert openings and organizer openings aligned with corresponding insert openings. The organizer openings have a smaller diameter than the insert openings and the insert openings have a lip that extends into the insert opening. Electrical connectors are received in the housing that have shells and include clips surrounding corresponding shells. The clips engage the lips of the insert openings for securing the electrical connectors in the insert openings. The organizer openings circumferentially surround the shells and restrict lateral movement of the electrical connectors.

18 Claims, 9 Drawing Sheets

RF CONNECTOR ASSEMBLY

BACKGROUND OF THE INVENTION

The subject matter herein relates generally to electrical connector assemblies, and more particularly to RF connectors.

Due to their favorable electrical characteristics, coaxial cables and connectors have grown in popularity for interconnecting electronic devices and peripheral systems. Typically, one connector is mounted to a circuit board of an electronic device at an input/output port of the device and extends through an exterior housing of the device for connection with a coaxial cable connector. The connectors include an inner conductor coaxially disposed within an outer conductor, with a dielectric material separating the inner and outer conductors.

A typical application utilizing coaxial cable connectors is a radio-frequency (RF) application having RF connectors designed to work at radio frequencies in the UHF and/or VHF range. RF connectors are typically used with coaxial cables and are designed to maintain the shielding that the coaxial design offers. RF connectors are typically designed to minimize the change in transmission line impedance at the connection by utilizing contacts that have a short contact length. The connectors have a short mating distance and, particularly when using multiple connectors in a single insert, typically include a pre-compressed spring to ensure the connectors are pushed forward and the contacts are engaged.

Known RF connectors having springs are not without disadvantages. For instance, known connectors not only allow compression along the axial direction of the connector, but also in lateral directions as well. During mating, the contact axes of the connectors may not be properly aligned with one another due to the lateral movement of the connectors. The spring thus forces the connector in an undesired direction and may cause damage to the contacts. Additionally, when both connectors are tilted off-center, there is a greater chance that the contacts are not properly aligned and may be damaged during mating.

A need remains for a connector assembly that may be manufactured in a cost effective and reliable manner. A need remains for a connector assembly that may be mated in a safe and reliable manner.

BRIEF DESCRIPTION OF THE INVENTION

In one embodiment, an electrical connector assembly is provided having a housing that has an insert and an organizer separate from, and coupled to, the insert. The insert and the organizer have insert openings and organizer openings aligned with corresponding insert openings. The organizer openings have a smaller diameter than the insert openings and the insert openings have a lip that extends into the insert opening. Electrical connectors are received in the housing that have shells and include clips surrounding corresponding shells. The clips engage the lips of the insert openings for securing the electrical connectors in the insert openings. The organizer openings circumferentially surround the shells and restrict lateral movement of the electrical connectors.

In another embodiment, an electrical connector system is provided having an electrical connector assembly that includes a housing that has an insert and an organizer separate from, and coupled to, the insert. The insert and the organizer have insert openings and organizer openings aligned with corresponding insert openings. The organizer openings have a smaller diameter than the insert openings. The insert openings have a lip extending into the insert opening. Electrical connectors are received in the housing that have shells and include clips surrounding corresponding shells. The clips engage the lips of the insert openings for securing the electrical connectors in the insert openings. The organizer openings circumferentially surround the shells and restrict lateral movement of the electrical connectors. The electrical connector system also includes an RF module having a housing that has walls that define a connector cavity and RF connectors received in the connector cavity. The electrical connector assembly is mated with the RF module such that the electrical connectors are mated with corresponding RF connectors.

DETAILED DESCRIPTION OF THE INVENTION

Figure 1:
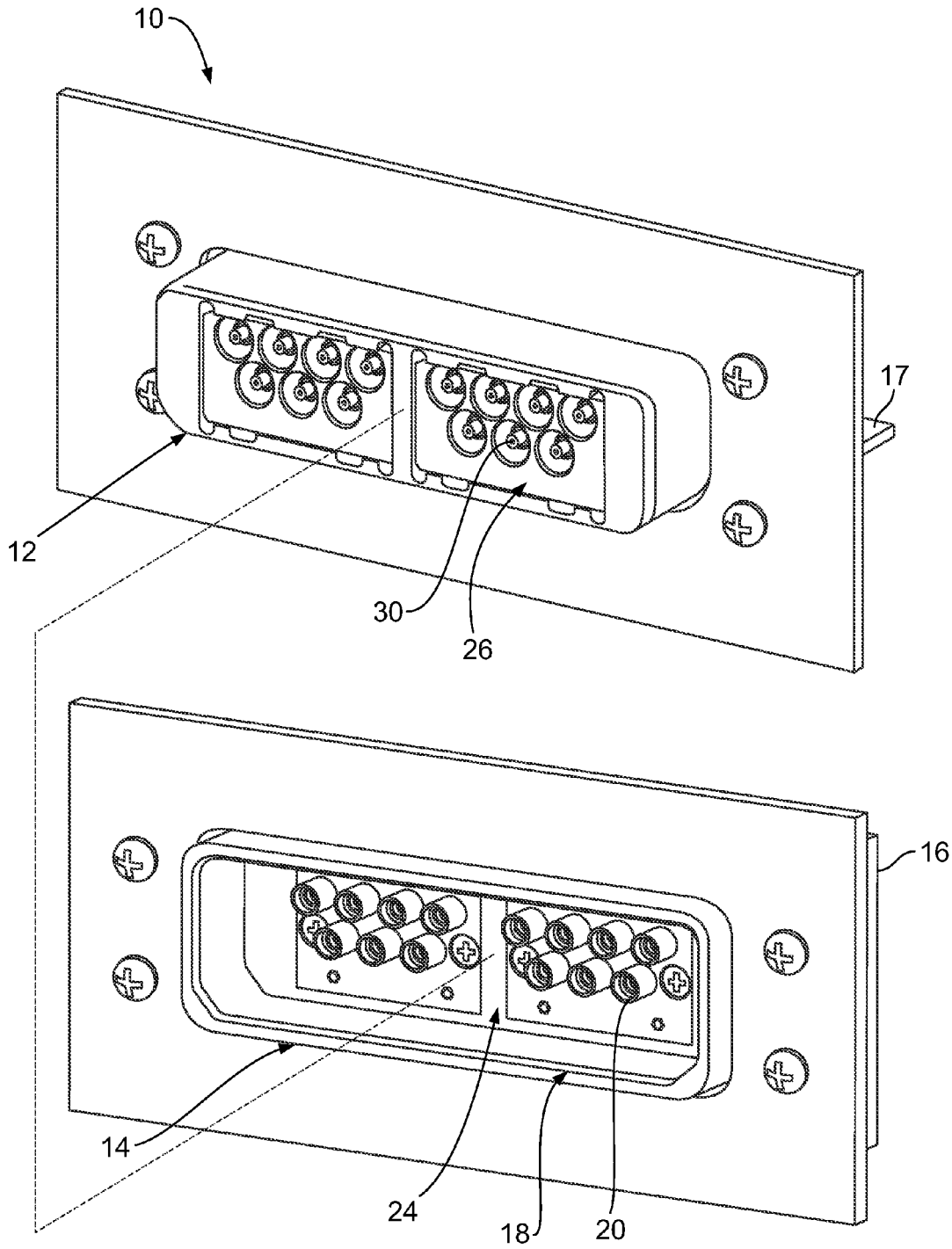
FIG. 1 illustrates an electrical connector system formed in accordance with an exemplary embodiment including an RF module and an electrical connector assembly.

FIG. 1 illustrates an electrical connector system 10 including an RF module 12 and an electrical connector assembly 14 formed in accordance with an exemplary embodiment. FIG. 1 shows front perspective views of both the RF module 12 and the electrical connector assembly 14, which are configured to be mated together along the phantom line shown in FIG. 1. In an exemplary embodiment, the electrical connector assembly 14 defines a motherboard assembly that is associated with a motherboard 16. The RF module 12 defines a daughtercard assembly that is associated with a daughtercard 17.

The electrical connector assembly 14 includes a housing 18 and a plurality of electrical connectors 20 held within the housing 18. Any number of electrical connectors 20 may be utilized depending on the particular application. In the illustrated embodiment, seven electrical connectors 20 are provided in two rows. The electrical connectors 20 are cable mounted to respective coaxial cables 22 (shown in FIG. 4). Alternatively, the electrical connectors 20 may be terminated to the motherboard 16. The housing 18 includes a mating cavity 24 that defines a receptacle for receiving the RF module 12.

In an exemplary embodiment, the RF module 12 defines a plug that may be received within the mating cavity 24. The RF module 12 includes a housing 26 and a plurality of RF connectors 30 held within the housing 26. The RF connectors 30 are cable mounted to respective coaxial cables 32 (shown in FIG. 4). The RF module 12 and electrical connector assembly 14 are mated with one another such that the electrical connectors 20 mate with the RF connectors 30. In alternative embodiments, the RF module 12 and electrical connector assembly 14 are both board mounted, or alternatively, one of the RF module 12 and electrical connector assembly 14 are cable mounted, while the other is board mounted.

Figure 2:
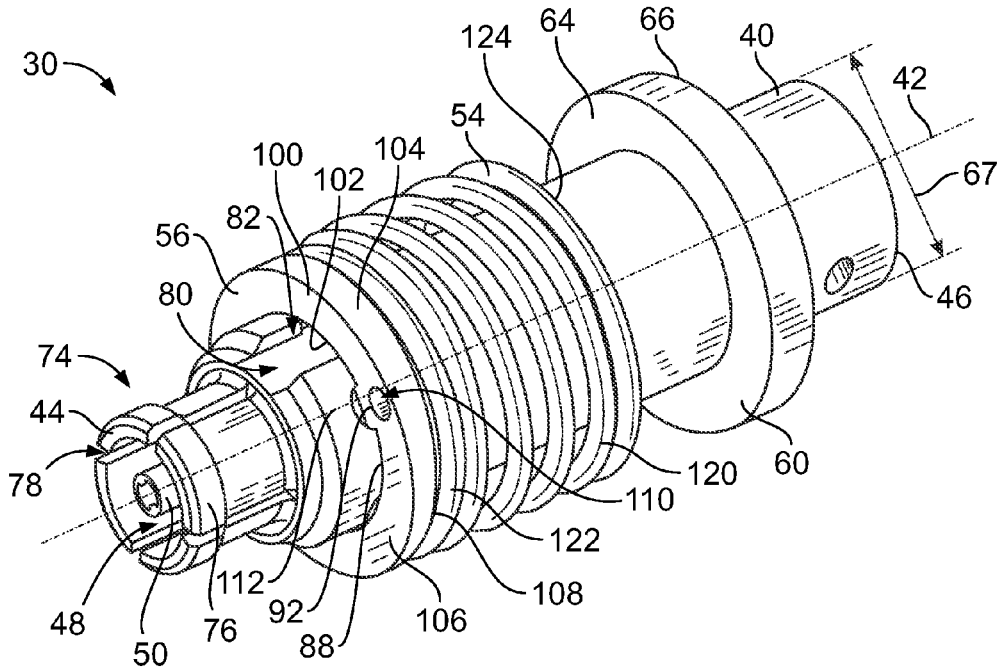
FIG. 2 is a perspective view of an RF connector for use with the system shown in FIG. 1.

FIG. 2 is a perspective view of one of the RF connectors 30. The RF connector 30 includes a shell 40 extending along a central longitudinal axis 42 between a mating end 44 and a cable end 46. The shell 40 defines a shell cavity 48. The RF connector 30 includes a center contact 50 held within the shell cavity 48. In an exemplary embodiment, a dielectric body 52 (shown in FIG. 3) is positioned between the shell 40 and the contact 50. In an exemplary embodiment, the shell 40 is formed from a conductive material, such as a metal material, and the dielectric body 52 electrically separates the contact 50 and the shell 40. The RF connector 30 includes a spring 54 concentrically surrounding a portion of the shell 40. The RF connector 30 includes a retaining washer 56 used to retain the spring 54 in position with respect to the shell 40.

The shell 40 is cylindrical in shape. A flange 60 extends radially outward from the shell 40. The flange 60 is positioned proximate the cable end 46. In the illustrated embodiment, the flange 60 is positioned a distance from the mating end 44. The flange 60 includes a forward facing surface 64 and a rear facing surface 66. The surfaces 64, 66 are generally perpendicular with respect to the longitudinal axis 42.

The shell 40 is tapered or stepped at the mating end 44 such that a shell diameter 67 at the mating end 44 is smaller than along other portions of the shell 40. The shell 40 includes a tip portion 74 forward of the third shoulder 72. When the RF connector 30 is mated with the electrical connector 20 (shown in FIG. 1), the tip portion 74 is received within the electrical connector 20. In an exemplary embodiment, the tip portion 74 includes a plurality of segments 76 that are separated by gaps 78. The segments 76 are movable with respect to one another such that the segments 76 may be deflected toward one another to reduce the diameter of the tip portion 74 for mating with the electrical connector 20. Deflection of the segments 76 may cause a friction fit with the electrical connector 20 when mated.

The washer 56 includes a ring-shaped body 100 having a radially inner surface 102 and a radially outer surface 104. The washer 56 includes a forward facing surface 106 and a rear engagement surface 108.

The spring 54 has a helically wound body 120 extending between a front end 122 and a rear end 124. The rear end 124 faces the forward facing surface 64 of the flange 60. The spring 54 is loaded over the mating end 44 and concentrically surrounds a portion of the shell 40. The spring 54 has a spring diameter that is greater than the shell diameter 67. The spring 54 is compressible axially.

During assembly, the retaining washer 56 is loaded onto the mating end 44 of the shell 40 and holds the spring 54 in position relative to the shell 40. The rear engagement surface 108 of the washer 56 engages the front end 122 of the spring 54. Optionally, the washer 56 may at least partially compress the spring 54 such that the spring is biased against the washer 56.

Figure 3:
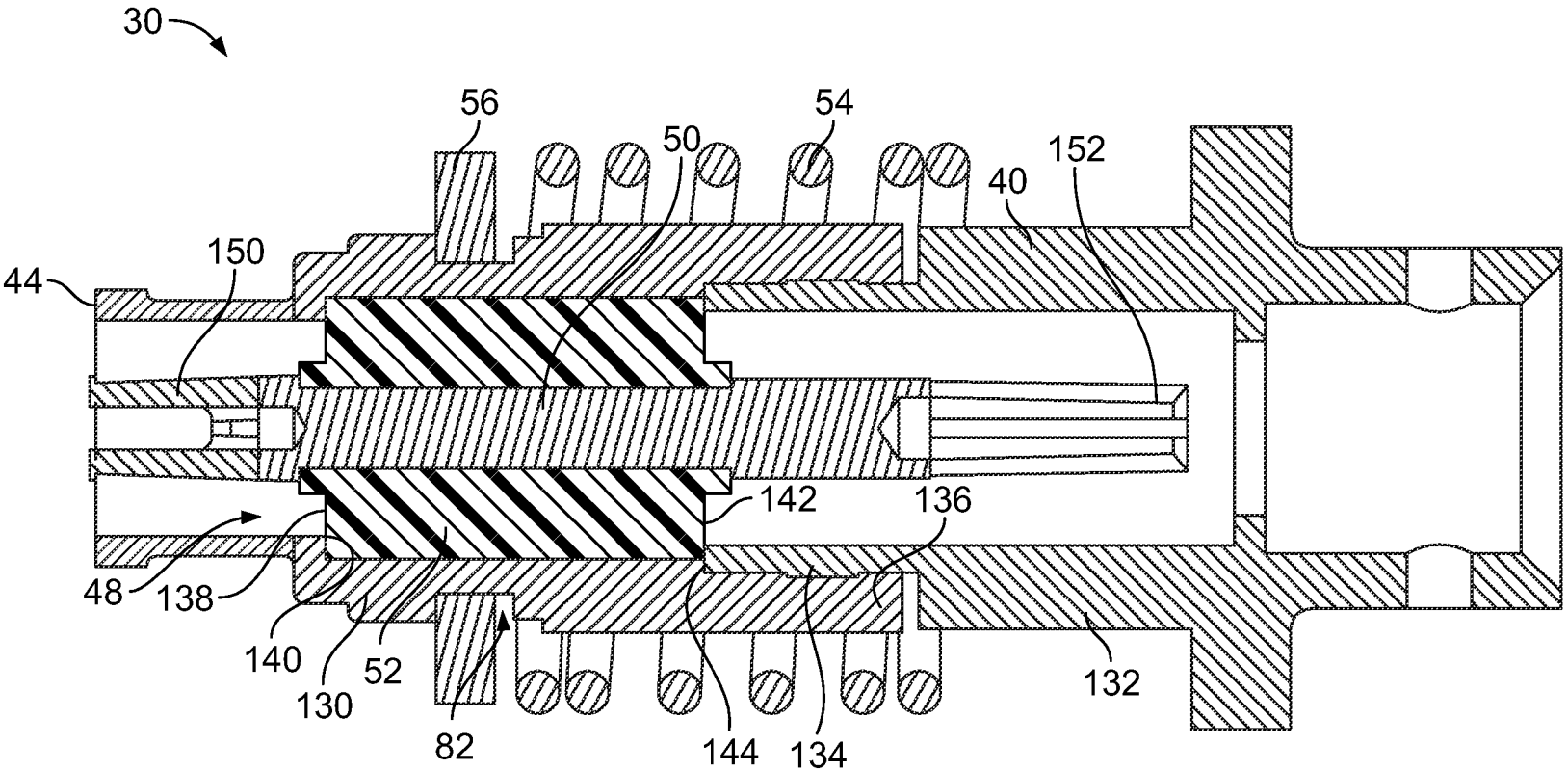
FIG. 3 is a cross-sectional view of the RF connector shown in FIG. 2.

FIG. 3 is a cross-sectional view of the RF connector 30. In the illustrated embodiment, the shell 40 includes a front shell 130 and a rear shell 132. A nose 134 of the rear shell 132 is received in a hood 136 of the front shell 130. The dielectric body 52 is held within the shell cavity 48. For example, a front end 138 of the dielectric body 52 engages a lip 140 of the front shell 130 proximate to the mating end 44. A rear end 142 of the dielectric body 52 engages a front surface 144 of the rear shell 132. The dielectric body 52 is captured in the front shell 130 by the rear shell 132.

The contact 50 is held within the shell cavity 48 by the dielectric body 52. The contact 50 includes a mating end 150 and a terminating end 152. The mating end 150 is configured to mate with a center contact 154 (shown in FIG. 4) of the electrical connector 20. The mating end 150 is positioned proximate to the mating end 44 of the shell 40. The terminating end 152 is configured to be terminated to a cable, such as, to a center conductor (not shown) of a coaxial cable. The rear shell 132 is configured to mechanically and/or electrically connected to the cable, such as, to the cable braid, the cable insulator and/or the cable jacket.

Figure 4:
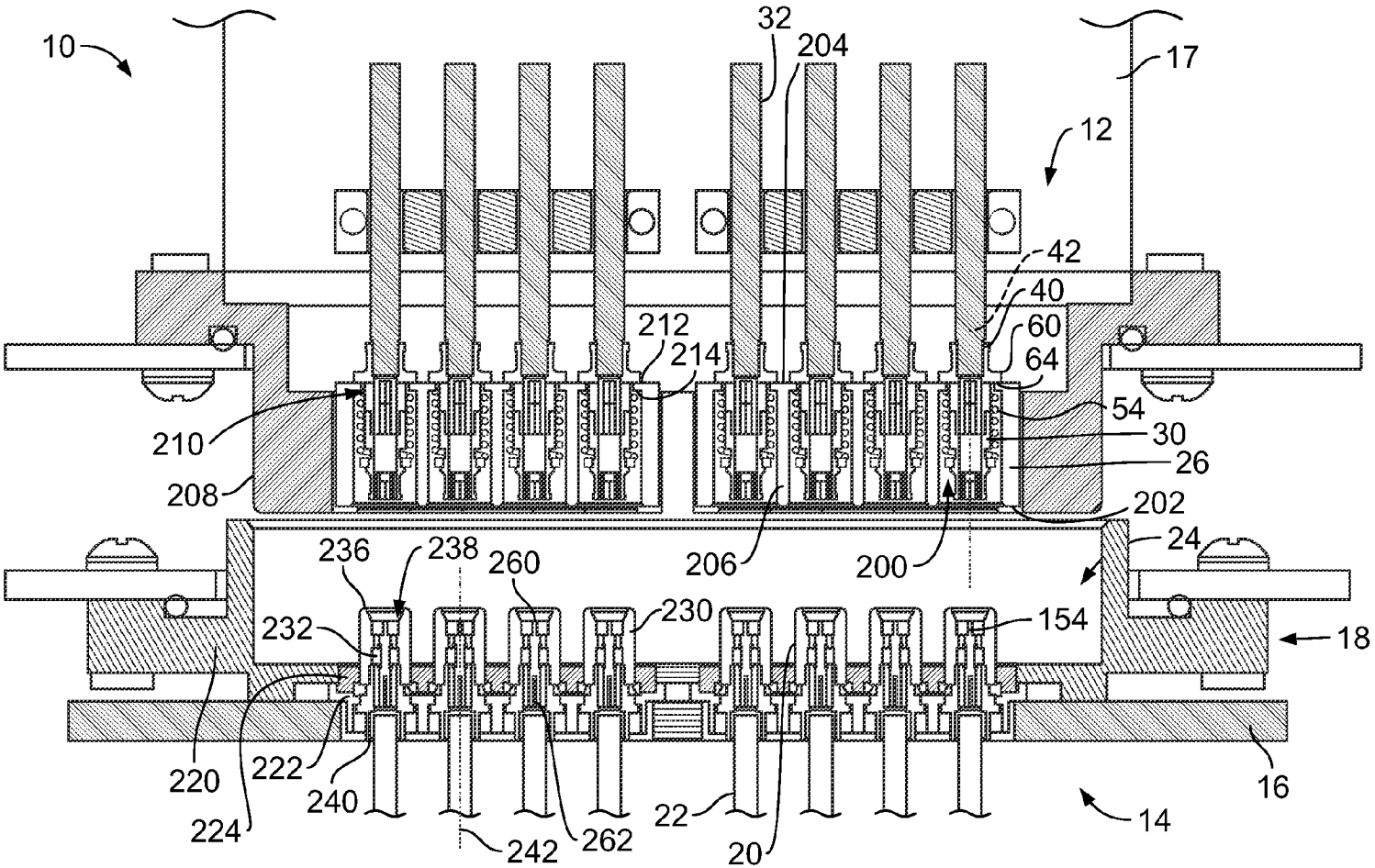
FIG. 4 is a partial cross-sectional view of the system shown in FIG. 1 illustrating the RF module and the electrical connector assembly poised for mating.

FIG. 4 is a partial cross sectional view of the connector system 10 illustrating the RF module 12 and electrical connector assembly 14 in an unmated position. The RF module 12 includes the housing 26 and a plurality of the RF connectors 30. The housing 26 includes a plurality of walls defining connector cavities 200. The housing 26 extends between a mating end 202 and a rear wall 204 on a back side of the housing 26. Some of the walls define interior walls 206 that separate adjacent connector cavities. Optionally, the connector cavities 200 may be cylindrical in shape. In the illustrated embodiment, the housing 26 is received in a chassis 208 that is part of the daughtercard assembly. Optionally, a plurality of RF modules 12 may be coupled within the chassis 208. The RF modules 12 may be identical to one another, or alternatively, different types of RF modules or other types of modules may be held in the chassis 208.

The rear wall 204 includes a plurality of openings 210 therethrough that provide access to the connector cavities 200. The RF connectors 30 extend through the openings 210 into the connector cavities 200. In an exemplary embodiment, a portion of the shell 40 is positioned outside of the housing 26 (e.g. rearward or behind the rear wall 204), and a portion of the shell 40 is positioned inside the connector cavity 200. The rear wall 204 includes first and second sides 212, 214, with the first side 212 facing rearward and outside of the housing 26 and the second side 214 facing forward and into the connector cavity 200. In an exemplary embodiment, the RF connector 30 is received in the connector cavity 200 such that the forward facing surface 64 of the flange 60 faces and/or engages the first side 212 of the rear wall 204. The flange 60 defines a stop against the rear wall 204 that limits forward movement of the RF connector 30 relative to the housing 26. The spring 54 engages the second side 214 of the rear wall 204. In an exemplary embodiment, the spring 54 is biased against the rear wall 204 to position the RF connector 30 relative to the rear wall 204. As such, the rear wall 204 is positioned between the spring 54 and the flange 60.

The electrical connector assembly 14 includes the housing 18 and a plurality of the electrical connectors 20. The housing 18 and electrical connectors 20 are mounted to the motherboard 16. The electrical connectors 20 extend through an opening in the motherboard 16 and are connected to the coaxial cables 22. The housing 18 includes a main housing 220 having walls defining the mating cavity 24. The main housing 220 is coupled to the motherboard 16, such as using fasteners (not shown).

The housing 18 includes an insert 222 and an organizer 224 separate from, and coupled to, the insert 222. The electrical connectors 20 are held by the insert 222 and organizer 224 as a subassembly, which is coupled to the main housing 220. For example, the subassembly is positioned in an opening on the main housing 220 and secured to the main housing 220 using fasteners (not shown). The electrical connectors 20 extend from the organizer 224 at least partially into the mating cavity 24.

Each electrical connector 20 includes a shell 230, a dielectric body 232 received in the shell 230 and one of the contacts 154 held by the dielectric body 232. The dielectric body 232 electrically isolates the contact 154 from the shell 230. The shell 230 includes a mating end 236 having an opening 238 that receives the RF connector 30 during mating. The shell 230 includes a terminating end 240 that is terminated to the coaxial cable 22. The electrical connector 20 extends along a longitudinal axis 242. During mating, the longitudinal axis 42 of each RF connector 30 is generally aligned with the longitudinal axis 242 of the corresponding electrical connector 20.

The contact 154 includes a mating end 260 and a mounting end 262 that is terminated to a center conductor of the coaxial cable 22. Alternatively, the mounting end 262 may be terminated to the motherboard 16 using press-fit pins, such as an eye-of-the-needle pin. The mounting end 262 is securely coupled to the insert 222. The mating end 260 is securely held by the organizer 224. The mating end 260 extends beyond the organizer 224 for mating with the RF connector 30.

Figure 5:
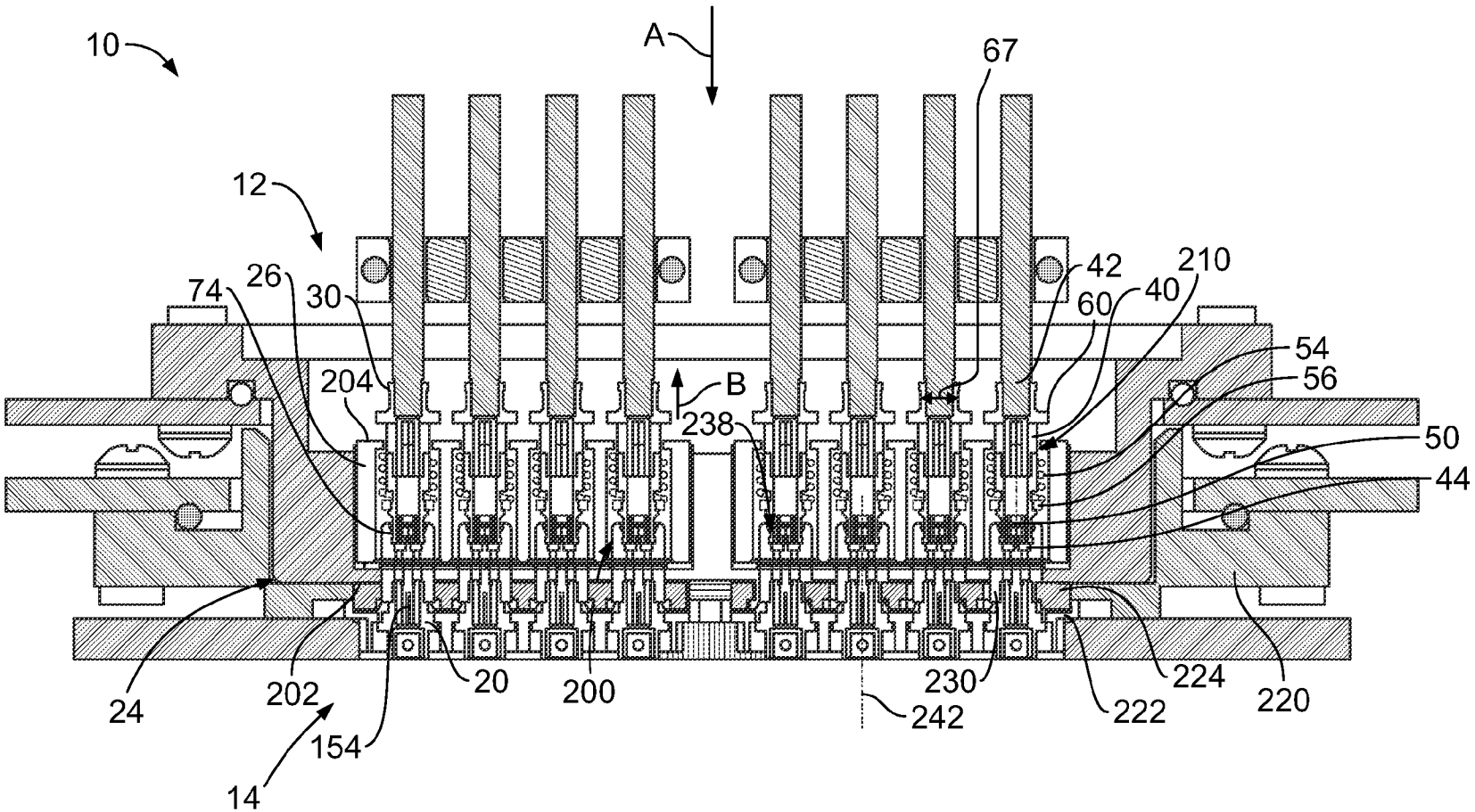
FIG. 5 is a partial cross sectional view of the connector system illustrating the RF module and electrical connector assembly in a mated position.

FIG. 5 is a partial cross sectional view of the connector system 10 illustrating the RF module 12 and electrical connector assembly 14 in a mated position. During mating, the RF module 12 is loaded into the mating cavity 24 in a loading direction, shown in FIG. 5 by an arrow A. Optionally, the RF module 12 is loaded into the mating cavity 24 until the mating end 202 of the housing 26 engages the main housing 220.

As the RF module 12 is mated with the electrical connector assembly 14, the RF connector 30 mates with the electrical connector 20. In the mated position, the tip portion 74 of the RF connector 30 is received in the opening 238 of the electrical connector 20. Optionally, the segments 76 (shown in FIG. 2) of the tip portion 74 may be flexed inward to fit within the opening 238. The tip portion 74 may be resiliently held within the opening 238. In the mated position, the contact 50 engages, and electrically connects to, the contact 154. In an exemplary embodiment, the shell 40 engages, and electrically connects to, the shell 230.

During mating, the spring 54 allows the RF connector 30 to float within the connector cavity 200 such that the RF connector 30 is capable of being repositioned with respect to the housing 26. Such floating or repositioning allows for proper mating of the RF connector 30 with the electrical connector 20. For example, the spring 54 may be compressed such that the relative position of the mating end 44 with respect to the rear wall 204 changes as the RF connector 30 is mated with the electrical connector 20. The organizer 224 holds the lateral position of the electrical connector 20 to keep the electrical connector 20 in position for mating with the RF connector 30. The organizer 224 resists tilting or rotating of the electrical connector 20 and keeps the electrical connector 20 extending along the longitudinal axis 242.

In an exemplary embodiment, the spring 54 may compress or flex to allow the RF connector 30 to reposition axially along the longitudinal axis 42 in a longitudinal direction, shown in FIG. 5 by the arrow B. A distance between the mating end 44 and the rear wall 204 may be shortened when the RF connector 30 is mated with the electrical connector 20. For example, when the tip portion 74 engages the electrical connector 20, the spring 54 may be compressed and the RF connector 30 may be recessed within the connector cavity 200. When the RF connector 30 is recessed within the connector cavity 200, the flange 60 is moved away from the rear wall 204. When the spring 54 is compressed, the spring 54 exerts a relatively higher biasing force against the washer 56 than when the spring 54 is not compressed, or when the spring 54 is less compressed. The biasing force is applied in a biasing direction, which may be generally along the longitudinal axis 42 toward the electrical connector 20. The spring 54 may maintain a reliable connection between the contact 50 and the mating contact 154 by forcing the RF connector 30 generally toward the electrical connector 20.

In addition to, or alternatively to, the axial repositioning of the RF connector 30, the RF connector 30 may be repositioned in a direction transverse to the longitudinal axis 42. For example, the RF connector 30 may be moved in a radial direction generally perpendicular with respect to the longitudinal axis 42. Optionally, the opening 210 in the rear wall 204 may have a larger diameter than the shell diameter 67 such that the shell 40 is movable within the opening in a non-axial direction (e.g. such as in a direction generally toward a portion of the opening 210). In an exemplary embodiment, in addition to, or alternatively to, the radial repositioning of the RF connector 30, the RF connector 30 may be repositioned by pivoting the RF connector 30 such that the longitudinal axis 42 is non-parallel to the central axis of the connector cavity 200. Such radial repositioning and/or pivoting may allow the RF connector 30 to align with the electrical connector 20 during mating. The organizer 224 rigidly holds the electrical connector 20 in position with respect to the main housing 220, generally parallel to the central axis of the connector cavities 200. The organizer 224 resists tilting and/or floating of the electrical connector 20.

In an exemplary embodiment, the RF connector 30 may float within the connector cavity 200 in at least two non-parallel directions. For example, the RF connector 30 may float in an axial direction, also known as a Z direction. The RF connector 30 may float in a first lateral direction and/or a second lateral direction, such as in directions commonly referred to as X and/or Y directions, which are perpendicular to the Z direction. The RF connector 30 may float in any combination of the X-Y-Z directions. The RF connector 30 may be pivoted, such that the mating end 44 is shifted in at least one of the lateral directions X and/or Y. The floating of the RF connector 30 may properly align the RF connector 30 with respect to the electrical connector 20. Optionally, the floating may be caused by engagement of the RF connector 30 with the electrical connector 20 during mating.

An exemplary embodiment of an RF module 12 is thus provided that may be manufactured in a cost effective and reliable manner. The RF module 12 may be mated with the electrical connector assembly 14 in a reliable manner. The RF connector 30 is movably received within the connector cavity 200 to properly mate with the electrical connector 20. In an exemplary embodiment, the RF connector 30 includes a spring 54 that allows the RF connector 30 to float within the connector cavity 200 in a plurality of directions or along a range of different movements. Assembly of the RF connector 30 is simplified by providing the spring 54 on the outside of the RF connector 30 and using the washer 56 to hold the spring 54 against the rear wall 204.

Figure 6:
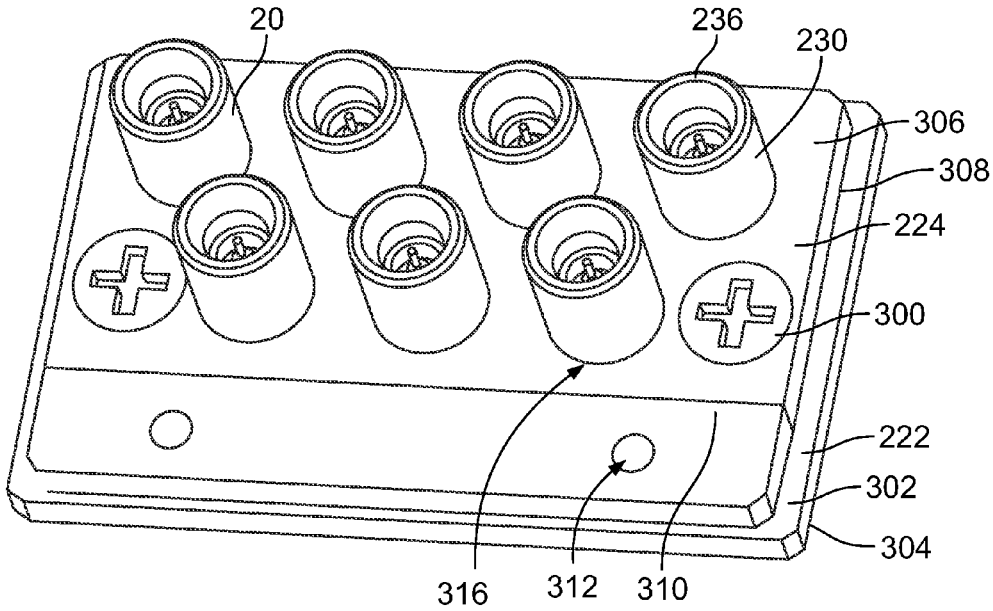
FIG. 6 is a front perspective view of a portion of the electrical connector assembly shown in FIG. 1.
Figure 7:
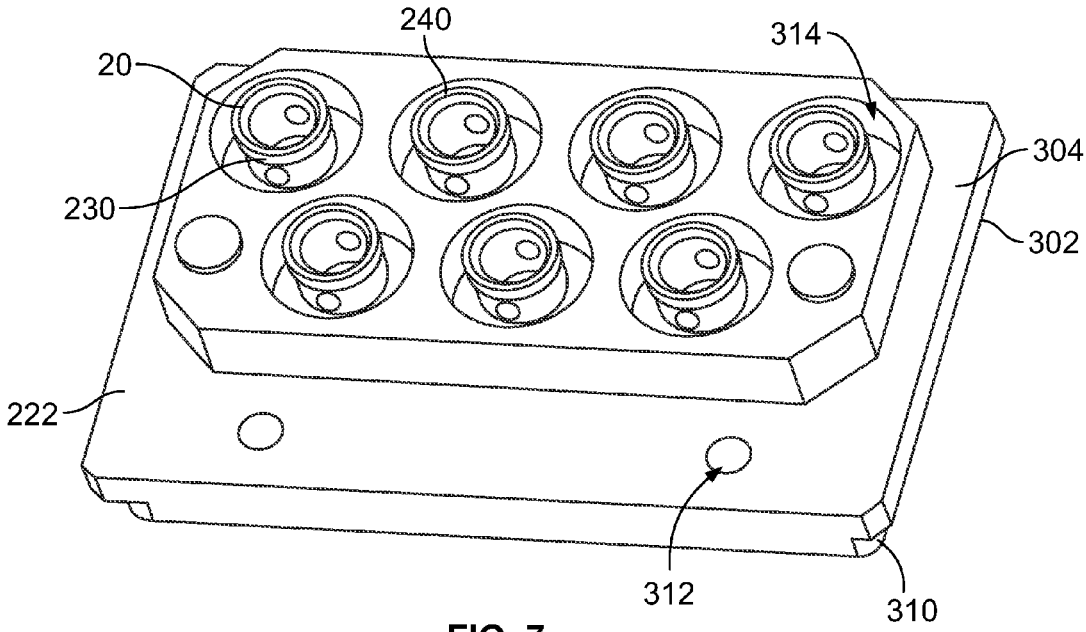
FIG. 7 is a rear perspective view of the electrical connector assembly shown in FIG. 6 with an electrical connector poised for loading into the electrical connector assembly.

FIG. 6 is a front perspective view of a portion of the electrical connector assembly 14 illustrating the insert 222, the organizer 224, and the electrical connectors 20 with the main housing 220 removed for clarity. FIG. 7 is a rear perspective view of the insert 222 and the organizer 224 with one of the electrical connectors 20 poised for loading into the insert 222. The organizer 224 is separate from the insert 222 and is coupled to the insert 222 using fasteners 300. The insert 222 holds the terminating ends 240 of the electrical connectors 20. The organizer 224 holds the mating ends 236 of the electrical connectors 20.

The insert 222 includes a front 302 and a rear 304. The organizer 224 includes a front 306 and a rear 308. The organizer 224 is coupled to the front 302 of the insert 222 such that the rear 308 of the organizer 224 rests on the front 302 of the insert 222. Optionally, the insert 222 includes a ledge 310 extending from the front 302. The organizer 224 rests on the ledge 310. The front 306 of the organizer 224 is flush with a front of the ledge 310. The ledge 310 includes openings 312 therethrough that receive fasteners (not shown) for coupling the insert 222 to the main housing 220.

The insert 222 includes a plurality of insert opening 314 extending therethrough. The insert openings 314 receive the electrical connectors 20 therein. The insert openings 314 are sized to receive the widest part of the electrical connectors 20.

The organizer 224 includes a plurality of organizer openings 316 extending therethrough. The organizer openings 316 receive the electrical connectors 20. When the organizer 224 is coupled to the insert 222, the organizer openings 316 are aligned with the insert openings 314. Optionally, the organizer 224 may be coupled to the insert 222 prior to the electrical connectors 20 being loaded into the insert openings 314 and organizer openings 316. Alternatively, the electrical connectors 20 may be loaded into the insert openings 314 prior to the organizer 224 being coupled to the insert 222. The organizer openings 316 are sized substantially similar to the diameter of the shell 230 at the mating end 236. The electrical connectors 20 may have a tight fit in the organizer openings 316 such that the organizer 224 limits movement of the electrical connectors 20 in lateral directions. As such, the organizer 224 may rigidly hold the electrical connectors 20 with respect to the insert 222 and the organizer 224.

Figure 8:
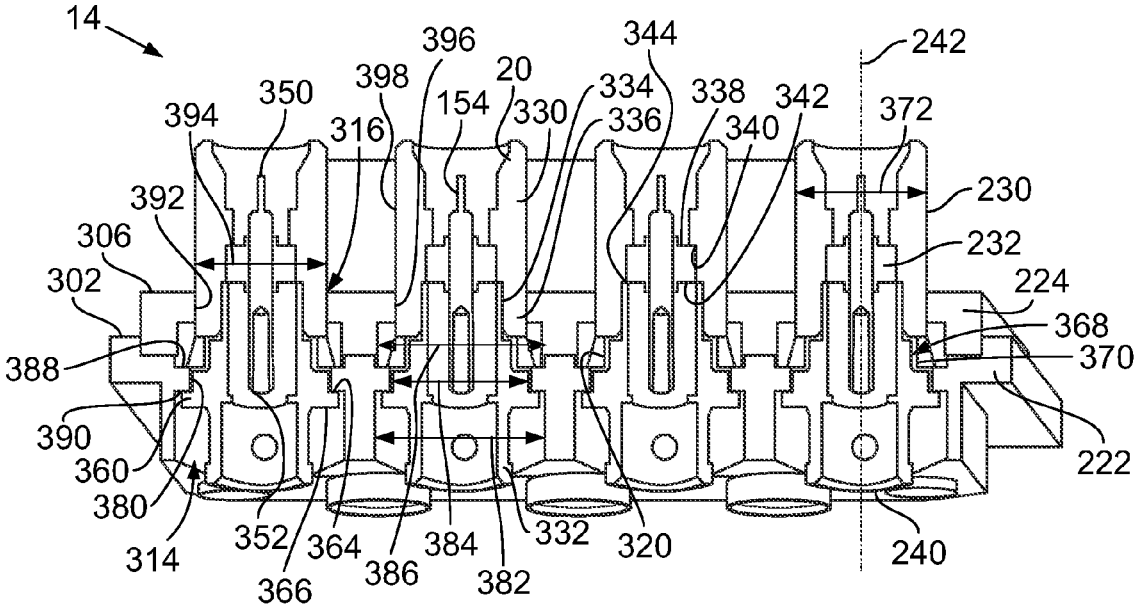
FIG. 8 is a cross-sectional view of the electrical connector assembly shown in FIG. 1.

FIG. 8 is a cross-sectional view of a portion of the electrical connector assembly 14 showing the electrical connectors 20 held within the insert 222 and the organizer 224. The electrical connectors 20 are coupled to the insert 222 using clips 320. The clips 320 may be split ring clips that are received around the shell 230. The clips 320 are compressible, such that a diameter of the clips 320 may be changed to allow the electrical connectors 20 to be loaded into the insert 222 and then expandable to allow the clips 320 to be captured by the insert 222.

In the illustrated embodiment, the shell 230 includes a front shell 330 and a rear shell 332. A nose 334 of the rear shell 332 is received in a hood 336 of the front shell 330. The dielectric body 232 is held within the front shell 330. The dielectric body 232 is captured in the front shell 330 by the rear shell 332. For example, a front end 338 of the dielectric body 232 engages a lip 340 of the front shell 330. A rear end 342 of the dielectric body 232 engages a front surface 344 of the rear shell 332. The dielectric body 232 is captured in the front shell 330 by the rear shell 332. The contact 154 is held within the shell 230 by the dielectric body 232. The contact 154 includes a mating end 350 and a terminating end 352. The mating end 350 is configured to mate with the center contact 50 (shown in FIG. 4) of the RF connector 30 (shown in FIG. 4). The terminating end 352 is configured to be terminated to a cable, such as to a center conductor (not shown) of the coaxial cable 22 (shown in FIG. 1). The rear shell 332 is configured to mechanically and/or electrically connect to the cable, such as to the cable braid, the cable insulator and/or the cable jacket.

The shell 230 is cylindrical in shape. The shell 230 may be stepped along the longitudinal axis 242. In an exemplary embodiment, a flange 360 extends radially outward from the rear shell 332. The flange 360 is positioned proximate the terminating end 240. The flange 360 includes a forward facing surface 364 and a rear facing surface 366. The surfaces 364, 366 are generally perpendicular with respect to the longitudinal axis 242. The shell 230 is stepped inward forward of the flange 360 to define a groove 368. In the illustrated embodiment, the groove 368 is positioned immediately rearward of the front shells 330. The groove 368 extends circumferentially around the rear shell 332. The groove 368 includes a forward facing surface 370. The shell 230 generally has a shell diameter 372 along the length thereof. The diameter is increased at the flange 360. The diameter is decreased at the groove 368.

In an exemplary embodiment, the clip 320 is received in the groove 368. The clip 320 is used to hold the electrical connectors 20 within the insert 222. The clip 320 is compressible, such as when the electrical connector 20 is loaded into the insert 222. When the electrical connector 20 is fully loaded into the insert 222, the clip 320 springs outward and is captured by a lip 380 of the insert 222. The clip 320 resists rearward movement of the electrical connector 20 with respect to the insert 222. When the clip 320 is captured behind the lip 380, the electrical connector 20 cannot be removed from the insert 222. Removal of the electrical connector 20 from the insert 222 requires removal of the organizer 224 from the insert 222, which exposes the clip 320. With the organizer 224 removed, the clip 320 may be compressed, such as by squeezing the clip 320. Once compressed, the clip 320 may be passed through the insert opening 314 past the lip 380.

The lip 380 extends into the insert opening 314 from the walls defining the insert opening 314. In an exemplary embodiment, the lip 380 extends circumferentially within the insert opening 314. The lip 380 may be positioned proximate to the front 302 of the insert 222. The insert opening 314 has a first diameter 382 rearward of the lip 380. The insert opening 314 has a second diameter 384 at the lip 380. The insert opening 314 has a third diameter 386 forward of the lip 380. The second diameter 384 is smaller than the first diameter 382 and the second diameter 386. In an exemplary embodiment, the first diameter 382 is equal to the third diameter 386. Alternatively, the first and third diameters 382, 386 may be different in alternative embodiments. The second diameter 384 is approximately equal to the shell diameter 372. The first diameter 382 is wide enough to accommodate the diameter of the flange 360. The third diameter 386 is wide enough to accommodate the spring back of the clip 320.

When the electrical connector 20 is loaded into the insert opening 314, the clip 320 is compressed and passed through the lip 380 until the clip 320 is positioned forward of the lip 380. The clip 320 may spring outward once the clip 320 passes the lip 380. The rear surface of the clip 320 engages a forward facing surface 388 of the lip 380 to resist rearward movement of the electrical connector 20 with respect to the insert 222. The electrical connector 20 is loaded into the insert opening 314 until the flange 360 engages the lip 380. The flange 360 engages a rearward facing surface 390 of the lip 380. The lip 380 is captured between the flange 360 and the clip 320. The longitudinal position of the electrical connector 20 is maintained by the flange 360 and the clip 320.

The organizer 224 is coupled to the insert 222 such that the organizer openings 316 are aligned with the insert openings 314. The organizer 224 includes rims 392 at the front 306. The rims 392 extend inward toward the electrical connectors 20. In an exemplary embodiment, the rims 392 have an opening diameter 394 that is substantially equal to the shell diameter 372. The rims 392 may engage the shell 230. For example, an inner perimeter 396 of the rim 392 may engage an outer perimeter 398 of the shell 230. The engagement of the organizer 224 with the electrical connectors 20 holds the lateral position (e.g. in the X and/or Y direction) of the electrical connectors 20 with respect to the insert 222 and the organizer 224. For example, having the rim 392 engage the shell 230 resists lateral movement (e.g., side-to-side movement and/or up and down movement) of the electrical connectors 20. Having the organizer 224 separate from the insert 222 allows the organizer 224 to be removed from the insert 222. Removal of the organizer 224 allows access to the clips 320 so that the clips 320 may be compressed and the electrical connectors 20 may be removed from the insert openings 314. Without removal of the organizer 224, access to the clips 320 would be denied making removal of the electrical connectors 20 from the insert 222 difficult or impossible.

Figure 9:
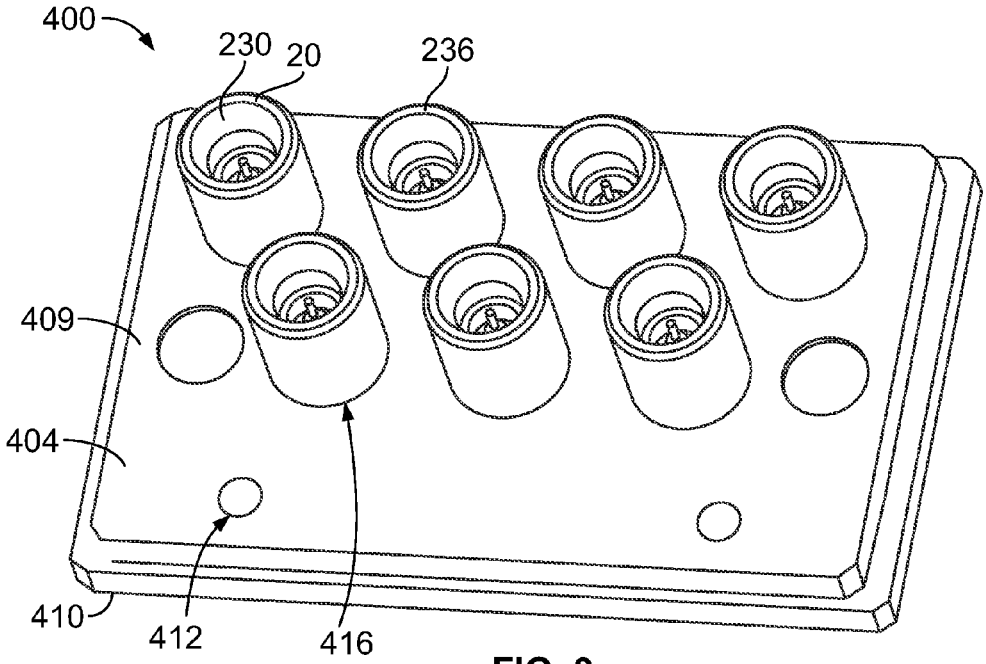
FIG. 9 is a front perspective view of an alternative electrical connector assembly.
Figure 10:
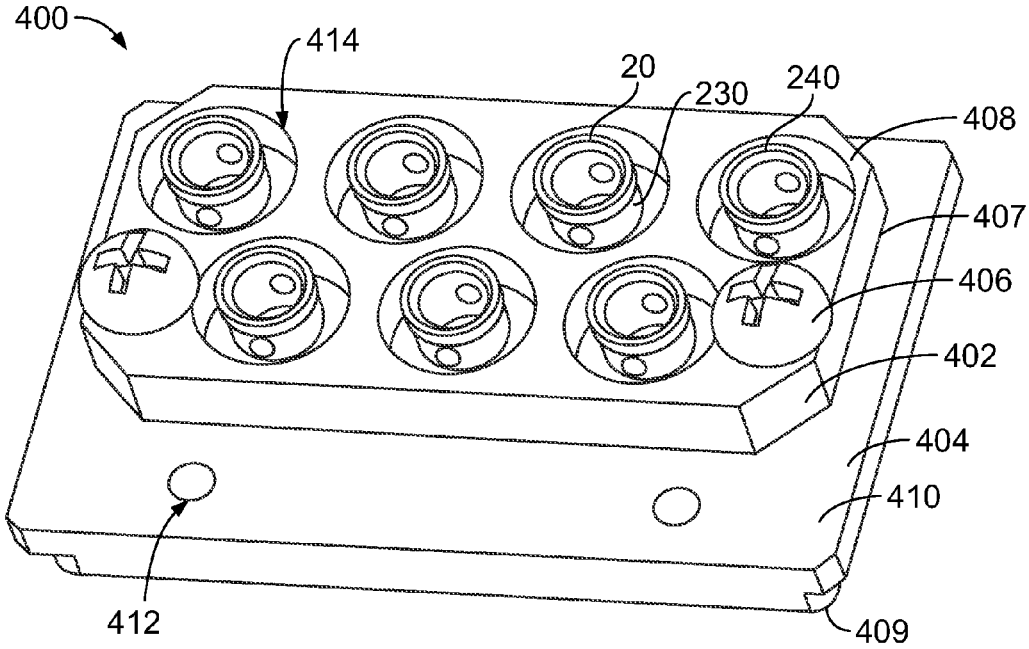
FIG. 10 is a rear perspective view of the electrical connector assembly shown in FIG. 9.

FIG. 9 is a front perspective view of a portion of an alternative electrical connector assembly 400 illustrating the electrical connectors 20 loaded into an insert 402 and an organizer 404 of the electrical connector assembly 400. FIG. 10 is a rear perspective view of the insert 402 and the organizer 404 with one of the electrical connectors 20 poised for loading into the insert 402. The organizer 404 is separate from the insert 402 and is coupled to the insert 402 using fasteners 406. The insert 402 holds the terminating ends 240 of the electrical connectors 20. The organizer 404 holds the mating ends 236 of the electrical connectors 20.

The insert 402 includes a front 407 and a rear 408. The organizer 404 includes a front 409 and a rear 410. The organizer 404 is coupled to the front 407 of the insert 402 such that the rear 410 of the organizer 404 rests on the front 407 of the insert 402. The organizer 404 includes openings 412 therethrough that receive fasteners (not shown) for coupling the subassembly to a main housing (not shown).

The insert 402 includes a plurality of insert opening 414 extending therethrough. The insert openings 414 receive the electrical connectors 20 therein. The insert openings 414 are sized to receive the widest part of the electrical connectors 20.

The organizer 404 includes a plurality of organizer openings 416 extending therethrough. The organizer openings 416 receive the electrical connectors 20. When the organizer 404 is coupled to the insert 402, the organizer openings 416 are aligned with the insert openings 414. Optionally, the electrical connectors 20 may be loaded into the insert openings 414 prior to the organizer 404 being coupled to the insert 402. Alternatively, the organizer 404 may be coupled to the insert 402 prior to the electrical connectors 20 being loaded into the insert openings 414 and organizer openings 416. The organizer openings 416 are sized substantially similar to the diameter of the shell 230 at the mating end 236. The electrical connectors 20 may have a tight fit in the organizer openings 416 such that the organizer 404 limits movement of the electrical connectors 20 in lateral directions. As such, the organizer 404 may rigidly hold the electrical connectors 20 with respect to the insert 402 and the organizer 404.

Figure 11:
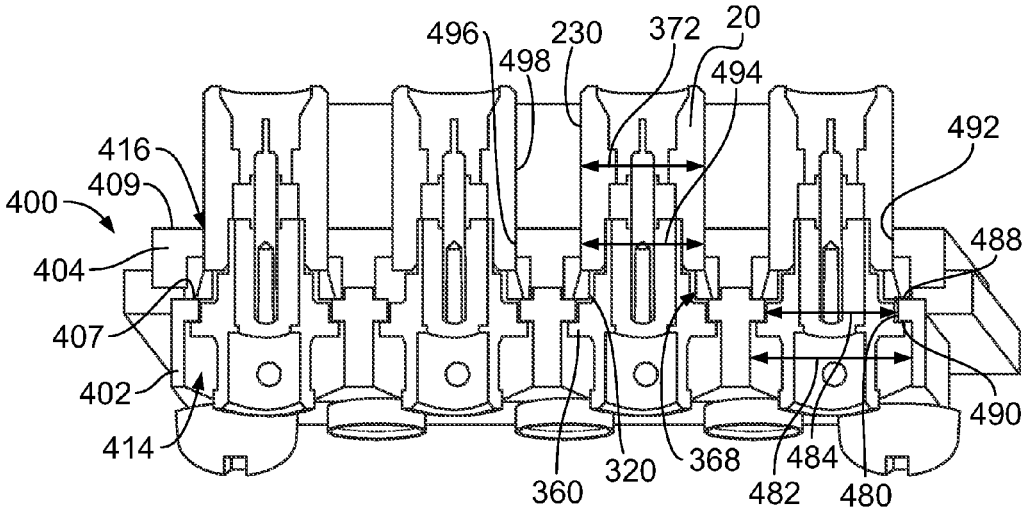
FIG. 11 is a cross-sectional view of the electrical connector assembly shown in FIG. 9.

FIG. 11 is a cross-sectional view of a portion of the electrical connector assembly 400 showing the electrical connectors 20 held within the insert 402 and the organizer 404. The clip 320 is received in the groove 368 of the shell 230. The clip 320 is used to hold the electrical connectors 20 within the insert 402. The clip 320 is compressible, such as when the electrical connector 20 is loaded into the insert 402. When the electrical connector 20 is fully loaded into the insert 402, the clip 320 springs outward and is captured by a lip 480 of the insert 402. In the illustrated embodiment, the lip 480 is provided at the front 407 of the insert 402. The clip 320 resists rearward movement of the electrical connector 20 with respect to the insert 402. When the clip 320 is captured behind the lip 480, the electrical connector 20 cannot be removed from the insert 402. Removal of the electrical connector 20 from the insert 402 requires removal of the insert 402 from the organizer 404, which exposes the clip 320. With the insert 402 removed, the clip 320 may be compressed, such as by squeezing the clip 320. Once compressed, the clip 320 may be passed through the insert opening 414 past the lip 480.

The lip 480 extends into the insert opening 414 from the walls defining the insert opening 414. In an exemplary embodiment, the lip 480 extends circumferentially within the insert opening 414. The insert opening 414 has a first diameter 482 rearward of the lip 480. The insert opening 414 has a second diameter 484 at the lip 480. The second diameter 484 is smaller than the first diameter 482.

When the electrical connector 20 is loaded into the insert opening 414, the clip 320 is compressed and passed through the lip 480 until the clip 320 is positioned forward of the lip 480. The clip 320 may spring outward once the clip 320 passes the lip 480. The rear surface of the clip 320 may engage a forward facing surface 488 of the lip 480 to resist rearward movement of the electrical connector 20 with respect to the insert 402. The electrical connector 20 is loaded into the insert opening 414 until the flange 360 engages the lip 480. The flange 360 engages a rearward facing surface 490 of the lip 480. The lip 480 is captured between the flange 360 and the clip 320. The longitudinal position of the electrical connector 20 is maintained by the flange 360 and the clip 320. The second diameter 484 is approximately equal to the shell diameter 372. The first diameter 482 is wide enough to accommodate the diameter of the flange 360.

The organizer 404 is coupled to the insert 402 such that the organizer openings 416 are aligned with the insert openings 414. The organizer 404 includes rims 492 at the front 409. The rims 492 extend inward toward the electrical connectors 20. In an exemplary embodiment, the rims 492 have an opening diameter 494 that is substantially equal to the shell diameter 372. The rims 492 may engage the shell 230. For example, an inner perimeter 496 of the rim 492 may engage an outer perimeter 498 of the shell 230. The engagement of the organizer 404 with the electrical connectors 20 holds the lateral position of the electrical connectors 20 with respect to the insert 402 and the organizer 404. For example, having the rim 492 engage the shell 230 resists lateral movement (e.g., side-to-side movement and/or up and down movement) of the electrical connectors 20. Having the organizer 404 separate from the insert 402 allows the insert 402 to be removed from the organizer 404. Removal of the insert 402 allows access to the clips 320 so that the clips 320 may be compressed and the electrical connectors 20 may be removed from the insert openings 414. Without removal of the insert 402, access to the clips 320 would be denied making removal of the electrical connectors 20 from the insert 402 difficult or impossible.

Figure 12:
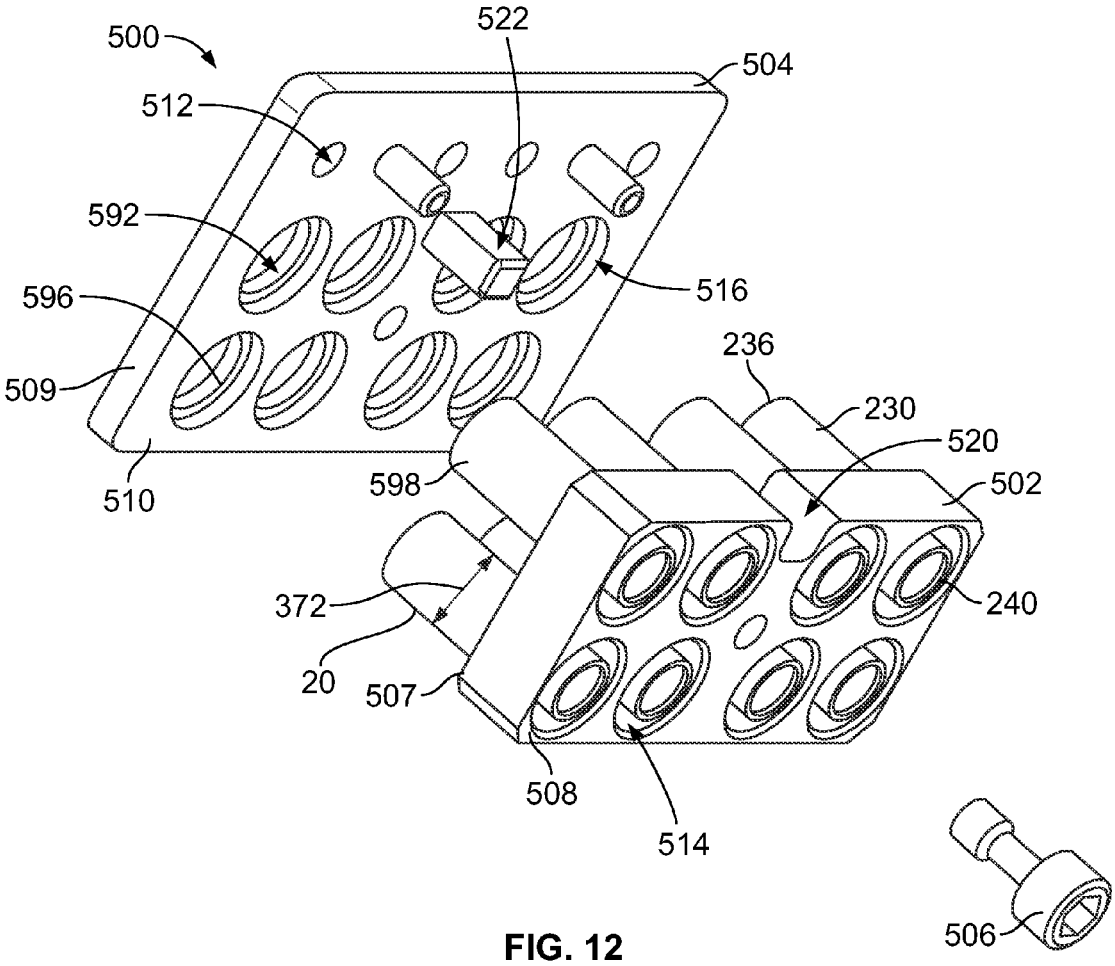
FIG. 12 is an exploded view of another alternative electrical connector assembly.

FIG. 12 is an exploded, rear perspective view of a portion of an alternative electrical connector assembly 500 illustrating the electrical connectors 20 loaded into a insert 502 and poised for mating with an organizer 504 of the electrical connector assembly 500. The organizer 504 is separate from the insert 502 and is coupled to the insert 502 using a fastener 506. The insert 502 holds the terminating ends 240 of the electrical connectors 20. The organizer 504 is configured to hold the mating ends 236 of the electrical connectors 20. In the illustrated embodiment, the insert 502 and organizer 504 are configured to hold eight electrical connectors 20 in two rows. Any number of electrical connectors 20 may be held in alternative embodiments.

The insert 502 includes a front 507 and a rear 508. The organizer 504 includes a front 509 and a rear 510. The organizer 504 is coupled to the front 507 of the insert 502 such that the rear 510 of the organizer 504 rests on the front 507 of the insert 502. The organizer 504 includes openings 512 therethrough that receive fasteners (not shown) for coupling the subassembly to a main housing (not shown).

The insert 502 includes a plurality of insert opening 514 extending therethrough. The insert openings 514 receive the electrical connectors 20 therein. The insert openings 514 are sized to receive the widest part of the electrical connectors 20.

The organizer 504 includes a plurality of organizer openings 516 extending therethrough. The organizer openings 516 receive the electrical connectors 20. When the organizer 504 is coupled to the insert 502, the organizer openings 516 are aligned with the insert openings 514. Optionally, the electrical connectors 20 may be loaded into the insert openings 514 prior to the organizer 504 being coupled to the insert 502. Alternatively, the organizer 504 may be coupled to the insert 502 prior to the electrical connectors 20 being loaded into the insert openings 514 and organizer openings 516.

The organizer openings 516 are sized substantially similar to the diameter of the shell 230 at the mating end 236. For example, the organizer openings 516 may include rims 592 at the front 509. The rims 592 extend inward toward the electrical connectors 20. In an exemplary embodiment, the rims 592 have an opening diameter that is substantially equal to the shell diameter 372. The rims 592 may engage the shell 230. For example, an inner perimeter 596 of the rim 592 may engage an outer perimeter 598 of the shell 230. The engagement of the organizer 504 with the electrical connectors 20 holds the lateral position of the electrical connectors 20 with respect to the insert 502 and the organizer 504. For example, having the rim 592 engage the shell 230 resists lateral movement (e.g., side-to-side movement and/or up and down movement) of the electrical connectors 20. As such, the organizer 504 may rigidly hold the electrical connectors 20 with respect to the insert 502 and the organizer 504.

Having the organizer 504 separate from the insert 502 allows the insert 502 to be removed from the organizer 504. Removal of the insert 502 allows access to the clips 320 (shown in FIG. 4) so that the clips 320 may be compressed and the electrical connectors 20 may be removed from the insert openings 514. Without removal of the insert 502, access to the clips 320 would be denied making removal of the electrical connectors 20 from the insert 502 difficult or impossible.

In an exemplary embodiment, the insert 502 includes a keying feature 520 and the organizer 504 includes a keying feature 522. The keying feature 520 constitutes a slot and the keying feature 522 constitutes a post that is received in the slot. Other types of keying features may be used in alternative embodiments. While only one keying feature 520 and keying feature 522 are illustrated, it is realized that multiple keying features may be used in alternative embodiments. The positioning of the keying features may be different in alternative embodiments.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a housing having an insert and an organizer separate from, and coupled to, the insert, the insert and the organizer having insert openings and organizer openings, aligned with corresponding insert openings, the organizer openings having a smaller diameter than the insert openings, the insert openings having a lip extending into the insert opening; and electrical connectors received in the housing, the electrical connectors having shells, the electrical connectors including clips surrounding corresponding shells, the clips engaging the lips of the insert openings for securing the electrical connectors in the insert openings, the organizer openings circumferentially surrounding the shells and restricting lateral movement of the electrical connectors.

2. The electrical connector assembly of claim 1, wherein the organizer is coupled to the insert by fasteners.

3. The electrical connector assembly of claim 1, wherein an outer perimeter of the shell engages an inner perimeter of the organizer opening.

4. The electrical connector assembly of claim 1, wherein each shell includes a mating end, the shell having a shell diameter at the mating end, the organizer opening having an opening diameter substantially equal to the shell diameter.

5. The electrical connector assembly of claim 1, wherein the shell includes a terminating end and a flange proximate to the terminating end, the clip being positioned forward of the flange, the lip being captured between the clip and the flange.

6. The electrical connector assembly of claim 1, wherein the insert opening has a first diameter rearward of the lip, a second diameter at the lip, and a third diameter forward of the lip, the second diameter being smaller than the first and third diameters, the second diameter being approximately equal to a shell diameter of the shell, the organizer opening having an opening diameter approximately equal to the shell diameter.

7. The electrical connector assembly of claim 1, wherein the insert and the organizer include keying features that orient the organizer with respect to the insert.

8. The electrical connector assembly of claim 1, wherein the electrical connectors are loaded into, and coupled to, the insert to form an insert subassembly, the insert subassembly being coupled to the organizer by simultaneously loading the electrical connectors through the organizer openings.

9. The electrical connector assembly of claim 1, wherein the insert is coupled to the organizer to form the housing, the electrical connectors being separately loaded into the housing.

10. An electrical connector system comprising:

an electrical connector assembly comprising a housing having an insert and an organizer separate from, and coupled to, the insert, the insert and the organizer having insert openings and organizer openings, aligned with corresponding insert openings, the organizer openings having a smaller diameter than the insert openings, the insert openings having a lip extending into the insert opening;

electrical connectors received in the housing, the electrical connectors having shells, the electrical connectors including clips surrounding corresponding shells, the clips engaging the lips of the insert openings for securing the electrical connectors in the insert openings, the organizer openings circumferentially surrounding the shells and restricting lateral movement of the electrical connectors; and an RF module comprising a housing having walls defining connector cavities and RF connectors received in the connector cavities, the electrical connector assembly is mated with the RF module such that the electrical connectors are mated with corresponding RF connectors.

11. The electrical connector system of claim 10, wherein the organizer is coupled to the insert by fasteners.

12. The electrical connector system of claim 10, wherein an outer perimeter of the shell engages an inner perimeter of the organizer opening.

13. The electrical connector system of claim 10, wherein each shell includes a mating end, the shell having a shell diameter at the mating end, the organizer opening having an opening diameter substantially equal to the shell diameter.

14. The electrical connector system of claim 10, wherein the shell includes a cable end and a flange proximate to the cable end, the clip being positioned forward of the flange, the lip being captured between the clip and the flange.

15. The electrical connector system of claim 10, wherein the insert opening has a first diameter rearward of the lip, a second diameter at the lip, and a third diameter forward of the lip, the second diameter being smaller than the first and third diameters, the second diameter being approximately equal to a shell diameter of the shell, the organizer opening having an opening diameter approximately equal to the shell diameter.

16. The electrical connector system of claim 10, wherein the insert and the organizer include keying features that orient the organizer with respect to the insert.

17. The electrical connector system of claim 10, wherein the electrical connectors are loaded into, and coupled to, the insert to form a insert subassembly, the insert subassembly being coupled to the organizer by simultaneously loading the electrical connectors through the organizer openings.

18. The electrical connector system of claim 10, wherein the insert is coupled to the organizer to form the housing, the electrical connectors being separately loaded into the housing.

* * * * *

UNITED STATES PATENT AND TRADEMARK OFFICE

CERTIFICATE OF CORRECTION

PATENT NO. : 8,029,324 B1
APPLICATION NO. : 12/939882
DATED : October 4, 2011
INVENTOR(S) : Yi et al.

It is certified that error appears in the above-identified patent and that said Letters Patent is hereby corrected as shown below:

Title Page, Col. 1, Item (75) (Inventors), line 2 (Inventor Name): Delete "Stephen J. Morley" and insert --Stephen T. Morley--, therefor.

Signed and Sealed this
Twenty-second Day of November, 2011

David J. Kappos

David J. Kappos
*Director of the United States Patent and Trademark Office*